US009326902B2

(12) United States Patent
Swanson et al.

(10) Patent No.: US 9,326,902 B2
(45) Date of Patent: May 3, 2016

(54) PORTABLE ENCLOSURE FOR A BED

(71) Applicant: Vivax Medical Corporation, Naugatuck, CT (US)

(72) Inventors: Richard L. Swanson, Oxford, CT (US); Brian DeRosa, Naugatuck, CT (US); Pamela Green, Torrington, CT (US)

(73) Assignee: VIVAX MEDICAL CORPORATION, Naugatuck, CT (US)

( * ) Notice: Subject to any disclaimer, the term of this patent is extended or adjusted under 35 U.S.C. 154(b) by 0 days.

(21) Appl. No.: 14/194,269

(22) Filed: Feb. 28, 2014

(65) Prior Publication Data

US 2014/0246064 A1 Sep. 4, 2014

Related U.S. Application Data

(60) Provisional application No. 61/771,298, filed on Mar. 1, 2013.

(51) Int. Cl.

| | |
|---|---|
| ***A61G 7/05*** | (2006.01) |
| ***A47C 29/00*** | (2006.01) |
| ***A61G 10/00*** | (2006.01) |
| *A47C 19/22* | (2006.01) |

(52) U.S. Cl.

CPC ..... *A61G 7/0526* (2013.01); *A47C 29/003* (2013.01); *A61G 10/005* (2013.01); *A47C 19/22* (2013.01)

(58) Field of Classification Search

CPC ..... A47C 21/08; A47C 19/22; A47C 29/003; A47C 29/006; A47C 7/66; A47C 31/002; A47C 19/00; A61G 7/0526; A61G 10/005; A47D 7/01; A47D 13/061; A47D 13/063; A47D 13/068

See application file for complete search history.

(56) References Cited

U.S. PATENT DOCUMENTS

| | | | | | |
|---|---|---|---|---|---|
| 372,570 | A | * | 11/1887 | Segar | 135/157 |
| 876,208 | A | * | 1/1908 | Osborne | 256/31 |
| 2,699,794 | A | | 1/1955 | Potter | |
| RE24,845 | E | * | 7/1960 | Heffernan et al. | 5/93.1 |
| 3,744,500 | A | * | 7/1973 | Briggs | 135/140 |
| 3,763,507 | A | * | 10/1973 | Propst | A47D 7/00 5/100 |
| 4,335,712 | A | * | 6/1982 | Trexler | A61G 10/005 128/205.26 |
| 4,641,387 | A | * | 2/1987 | Bondy et al. | 5/658 |
| 4,779,294 | A | * | 10/1988 | Miller | 135/121 |
| 4,945,586 | A | * | 8/1990 | Cross et al. | 5/414 |
| 5,339,470 | A | * | 8/1994 | Shamie | 5/98.1 |
| 5,384,925 | A | * | 1/1995 | Vail | 5/424 |
| 5,507,046 | A | * | 4/1996 | Taylor | 5/414 |
| 5,784,732 | A | * | 7/1998 | Vail | 5/430 |
| 6,067,676 | A | * | 5/2000 | Carnahan et al. | 5/99.1 |

(Continued)

*Primary Examiner* — David E Sosnowski
*Assistant Examiner* — David R Hare
(74) *Attorney, Agent, or Firm* — McCarter & English LLP

(57) ABSTRACT

An enclosure for enclosing an area including a frame and a canopy assembly. The frame includes an upper laterally-extending support, a first upstanding support coupled to a first end of the upper support, and a second upstanding support coupled to a second end of the upper support. The upper support is length-adjustable. The canopy assembly is connectable to the frame for defining an enclosed area, and includes a plurality of collars removably connectable to the frame, and at least one panel holdable in a plane defined by the supports of the frame. The circumference of at least one such collar is adjustable so that when the length of the upper support is adjusted, the collar circumference can be adjusted to accommodate the change in length.

18 Claims, 7 Drawing Sheets

(56) References Cited

U.S. PATENT DOCUMENTS

| | | | | |
|---|---|---|---|---|
| 6,216,291 | B1 * | 4/2001 | Eads et al. | 5/424 |
| 6,263,529 | B1 * | 7/2001 | Chadwick et al. | 5/414 |
| 6,263,894 | B1 * | 7/2001 | LaMantia | 135/96 |
| 6,487,735 | B1 * | 12/2002 | Jacques et al. | 5/424 |
| 6,687,930 | B1 * | 2/2004 | Eads et al. | 5/414 |
| 6,694,547 | B1 * | 2/2004 | Vail | 5/424 |
| 6,742,225 | B2 * | 6/2004 | Marty et al. | 24/382 |
| 7,047,991 | B2 * | 5/2006 | Kline | 135/96 |
| 7,322,056 | B2 * | 1/2008 | Cloward | 5/414 |
| 7,340,789 | B2 * | 3/2008 | Cloward | 5/414 |
| 7,406,725 | B2 * | 8/2008 | Martin et al. | 5/93.2 |
| 8,007,351 | B1 * | 8/2011 | Maloney | A61G 10/005 454/187 |
| 8,413,269 | B1 * | 4/2013 | Vail | 5/414 |
| 2003/0066132 | A1 | 4/2003 | Jacques, II et al. | |
| 2003/0116566 | A1 * | 6/2003 | Ellen et al. | 220/9.4 |
| 2006/0020159 | A1 | 1/2006 | Ellen | |
| 2007/0271698 | A1 * | 11/2007 | Cyr | 5/414 |
| 2007/0294827 | A1 * | 12/2007 | Carr et al. | 5/600 |
| 2012/0278995 | A1 | 11/2012 | Kaplan et al. | |

* cited by examiner 300
310
302
360
318
360
318
331
315
331
305
331

PORTABLE ENCLOSURE FOR A BED

CROSS REFERENCE TO RELATED APPLICATIONS

The application claims benefit under 35 U.S.C. §119 to U.S. Ser. No. 61/771,298 filed Mar. 1, 2013, entitled "Portable Enclosure For a Bed," which is incorporated in its entirety as if fully set forth herein.

FIELD OF THE INVENTION

The invention relates to an adjustable enclosure for an area. In particular, the enclosure can be used with a hospital bed to enclose the bed and a patient within the area.

BACKGROUND OF THE RELATED ART

Various illnesses and conditions such as brain trauma, dementia and Alzheimer's disease often leave people in such a condition that constant management of the patient is necessary to prevent further injury and mishap. Traditional systems and methods for monitoring and controlling patients with such needs have included bed straps or restraints, strait jackets, sedation, monitoring device(s), dedicated supervision, isolation rooms and the like, both alone and in combination. Many of these methods and systems are burdensome to all concerned and expensive. For example, bed straps immobilize a patient on a bed. When the patient desires to move or change position, the restraints prevent such shifting. As a result, a restrained patient can become very uncomfortable and/or agitated in addition to suffering medical complications. For another example, a dedicated person to attend to the restrained person's needs on an "all day, every day" basis is costly.

Several techniques for addressing confining a patient to an area, e.g., a bed, while allowing free movement have been developed to address the needs of the patient and caregiver. Some examples are illustrated in U.S. Pat. No. 6,216,291 to Eads et al. and U.S. Pat. No. 6,263,529 to Chadwick et al., each of which is incorporated herein by reference. However, there are problems associated with these prior art enclosure bed apparatuses. Often, the condition that requires restraint may be temporary and, as a result, transportation, assembly and disassembly of the enclosure may be common. These prior art systems require extensive manpower for assembly and disassembly. When disassembled, loose parts can be lost and transport and storage is cumbersome and difficult. To assemble, tools and excessive know-how and manpower are needed. When assembled, excessive bulk prevents easy transport and storage.

Commonly, a patient enters the hospital at the emergency room experiencing symptoms that convince the staff that some form of isolation is in order. Following initial evaluation, a determination may be made indicating that additional tests, evaluation, admission, surgery, or more acute care is required. As a result, the patient may require transfer to multiple locations within the hospital facility, each requiring some form of isolation or restraint.

In addition to the complexity of the prior systems, those systems also have not been able to accommodate adjustable beds or side rails of the beds. For example, hospital bed sizes are relatively uniform. However, the mechanisms of the side rails of the bed may vary between different manufacturers. Specifically, the side rails of some beds extend beyond the end of the bed, and therefore require additional space in the length direction of the bed. Furthermore, wider beds may be necessary for heavier patients, such as bariatric patients. Enclosures made in uniform dimensions to accommodate the standard bed cannot be adjusted to function with different length or width beds that vary from the norm.

SUMMARY OF THE INVENTION

The present invention is directed to an adjustable enclosure, e.g., for isolating a person to an area about a bed. The bed is adapted, for example, to support the person and includes a frame and a mattress overlying the frame. In some embodiments, the enclosure comprises a frame adapted to be positioned about an area, and a canopy assembly connectable to the frame for defining an enclosed area. The canopy assembly extends over the frame and is sufficiently large to allow a person located within the isolation chamber to be supported on the bed and to move freely within the area.

In certain embodiments, the frame includes at least an upper laterally extending support and first and second upstanding supports coupled to first and second ends of the upper laterally extending support. The upper laterally extending support is adjustable in a length direction of the support between at least a first position and a second position. The canopy assembly includes a plurality of collars configured to removably connect to canopy to the upper laterally extending support and the first and second upstanding supports. The canopy further includes at least one panel coupled to the plurality of collars such that the panel is held in a plane defined by the upper laterally extending support and the first and second upstanding supports. At least one of the plurality of collars is configured to be adjustable between at least a first circumference and second circumference.

In one embodiment a frame is adapted to be positioned about an area, the frame includes an upper laterally extending support, a first upstanding support coupled to a first end of the upper laterally extending support, and a second upstanding support coupled to a second end of the upper laterally extending support. The upper laterally extending support is adjustable in a length direction of the support between at least a first position and a second position. The canopy assembly is connectable to the frame for defining an enclosed area, and the canopy includes a plurality of collars configured to removably connect the canopy to the upper laterally extending support, the first upstanding support, and the second upstanding support, and at least one panel coupled to the plurality of collars such that the panel is held in a plane defined by the upper laterally extending support, the first upstanding support, and the second upstanding support. At least one of the plurality of collars is adjustable between at least a first circumference and a second circumference, and when the upper laterally extending support is adjusted from the first position to the second position, at least one of the plurality of adjustable collars attached to one of the first upstanding support or the second upstanding support is correspondingly adjustable from the first circumference to the second circumference for said collar to be connected to said at least one of the first upstanding support and the second upstanding support.

In another embodiment, when the upper laterally extending support is adjusted from the first position to the second position, at least one of the plurality of adjustable collars attached to one of the first upstanding support or the second upstanding support is adjusted from the first circumference to the second circumference.

The frame may further include an adjustable lower laterally extending support that is configured to be adjusted between the first and second positions.

In some embodiments, the adjustable frame elements may be expansion joints or other formers of expanders. For example, the expansion joint may be in the form of a telescoping bar, a splice bar, and/or overlapping plates or other adjustable means. Those skilled in the art will appreciate that other various forms of expansion may be used without departing from the scope of the invention.

In some embodiments, the at least one adjustable collar includes a fastener and a collar extension. The fastener may include first and second connectors defining third and fourth positions, respectively, with the collar extension disposed between the first and second connectors. When the upper laterally extending support is in the first position, the adjustable collar is in the third position, and when the upper laterally extending support is in the second position the adjustable collar is in the fourth position, and the third position corresponds to the first circumference and the fourth position corresponds to the second circumference.

In another embodiment an enclosure for enclosing an area includes a frame adapted to be positioned about an area and a canopy assembly connectable to the frame. The frame includes an upper laterally extending support, a first upstanding support coupled to a first end of the upper laterally extending support, and a second upstanding support coupled to a second end of the upper laterally extending support. The upper laterally extending support is adjustable in a length direction of the support between at least a first position and a second position. The canopy includes a plurality of collars configured to removably connect the canopy to the upper laterally extending support, the first upstanding support, and the second upstanding support, and at least one adjustable panel coupled to the plurality of collars such that the panel is held in a plane defined by the upper laterally extending support, the first upstanding support, and the second upstanding support. When the upper laterally extending support is adjusted from the first position to the second position, the at least one adjustable panel is correspondingly adjustable from a first length to a second length for at least one of the plurality collars to be connected to at least one of the first upstanding support and the second upstanding support.

In another embodiment an enclosure for enclosing an area, includes a frame adapted to be positioned about an area. The frame includes first means for supporting and for adjusting in length between at least a first position and a second position, a first upstanding support coupled to a first end of the first means, and a second upstanding support coupled to a second end of the first means. A canopy assembly is connectable to the frame for defining an enclosed area, the canopy includes second means for removably connecting the canopy to the first means, the first upstanding support, and the second upstanding support, third means for coupling to the second means such that the third means is held in a plane defined by the first means, the first upstanding support, and the second upstanding support, and fourth means for adjusting from a third position to a fourth position. When the first means is adjusted from the first position to the second position, the fourth means is correspondingly adjustable from the third position to the fourth position for at least one of said second means to be connected to at least one of the first upstanding support and the second upstanding support.

In another embodiment the first means is a length-adjustable laterally extending support, the second means is a plurality of collars, and the third means is a panel, and the fourth means is at least one of an adjustable portion of the panel and an adjustable portion of at least one of the plurality of collars.

In another embodiment a method for enclosing an area is provided. The method includes positioning an enclosure about an area, the enclosure including an adjustable frame comprising an upper laterally extending support, a first upstanding support coupled to a first end of the upper laterally extending support, and a second upstanding support coupled to a second end of the upper laterally extending support, wherein the upper laterally extending support is adjustable in a length direction of the support between at least a first position and a second position. The enclosure also includes an adjustable canopy configured to removably attach to the adjustable frame, the adjustable canopy comprising a plurality of collars configured to removably connect the canopy to the upper laterally extending support, the first upstanding support, and the second upstanding support, and at least one panel coupled to the plurality of collars such that the panel is held in a plane defined by the upper laterally extending support, the first upstanding support, and the second upstanding support. At least one of (i) the panel and (ii) at least one of the plurality of collars is adjustable between a third position and a fourth position. When the upper laterally extending support is adjusted from the first position to the second position, said at least one of said adjustable panel and said at least one adjustable collar is correspondingly adjustable from the third position to the fourth position for the canopy to be connected to at least one of the first upstanding support and the second upstanding support, and adjusting at least one of the adjustable frame and the adjustable canopy to change an area enclosed by the enclosure.

In another embodiment, adjusting at least one of the adjustable frame and the adjustable canopy includes adjusting the length of the upper laterally extending support in the length direction between the first position and the second position, and/or adjusting at least one of the adjustable panel and said at least one adjustable collar between the third position and the fourth position.

The fastener may be formed from zippers, complementary hook and loop fasteners (Velcro), or other means of fastening, such as ties, eyelets, snaps, buttons, or any other fastening means. Those skilled in the art will appreciate that the fastener may take any form of fastener without departing from the scope of the invention.

Accordingly, an advantage of one aspect of the present invention is found in an adjustable enclosure for surrounding and enclosing an area. The enclosed area may be varied in size as the frame and canopy of the enclosure are adjusted.

Another advantage of the present invention is found in the ability to contain or enclose various size beds and/or various types of bed functions without resorting to using two or more distinct enclosures.

Yet another advantage of the present invention is found in flexibility in application. Accordingly, it should be appreciated that the present invention can be implemented and utilized in numerous ways, including without limitation as a process, an apparatus, a system, a device and a method for applications now known and later developed. These and other unique features of the apparatus and method disclosed herein will become more readily apparent from the following description and the accompanying drawings.

Yet another advantage of the present invention is that the enclosure can be dimensioned to fit through doorways and hallways, such as conventional doorways and hallways and/or those encountered in hospitals. Thus, the enclosures are uniquely configured to transport an isolated patient throughout different locations, for example, within a hospital, without having to remove the patient from the enclosure area.

Yet another advantage of the present invention is to prevent "never events," or events that should never occur in a hospital. An example of a "never event" is a bed exit fall when a patient attempts to exit a bed and falls, potentially leading to injury to the patient. Embodiments of the present invention allow for prevention of such falls, or other never events, by isolating the patient to the bed or bed area, but still retaining some amount of freedom for the patient.

Accordingly, it is an object of the present invention to overcome one or more of the above-described drawbacks and/or disadvantages of the prior art. The enclosure can safely confine a patient to an area, such as on or around a bed. The enclosure permits the patient to be free to move within the area and/or on the bed, without the need for other types of restraints. In some embodiments, caregivers and attendants can see into the restrained area. In certain embodiments, caregivers and attendants can access the patient through selectively accessible and/or operable openings. In some embodiments, the patient has the ability to see and interact with the general environment around the enclosure. In some embodiments, when not in use, the enclosure can be removed and collapsed for easy storage and transport. As will be recognized by those of ordinary skill in the pertinent art based on the teachings herein, the canopy and enclosure of the present invention are equally usable with frames that are not collapsible, and/or frames that are mountable on the bed frame, or otherwise fixedly securable to the bed frame, or otherwise fixedly secured.

BRIEF DESCRIPTION OF THE DRAWINGS

So that those having ordinary skill in the art to which the disclosed invention appertains will more readily understand how to make and use the same, reference may be had to the drawings wherein.

DETAILED DESCRIPTION OF EMBODIMENTS OF THE INVENTION

Figure 1:
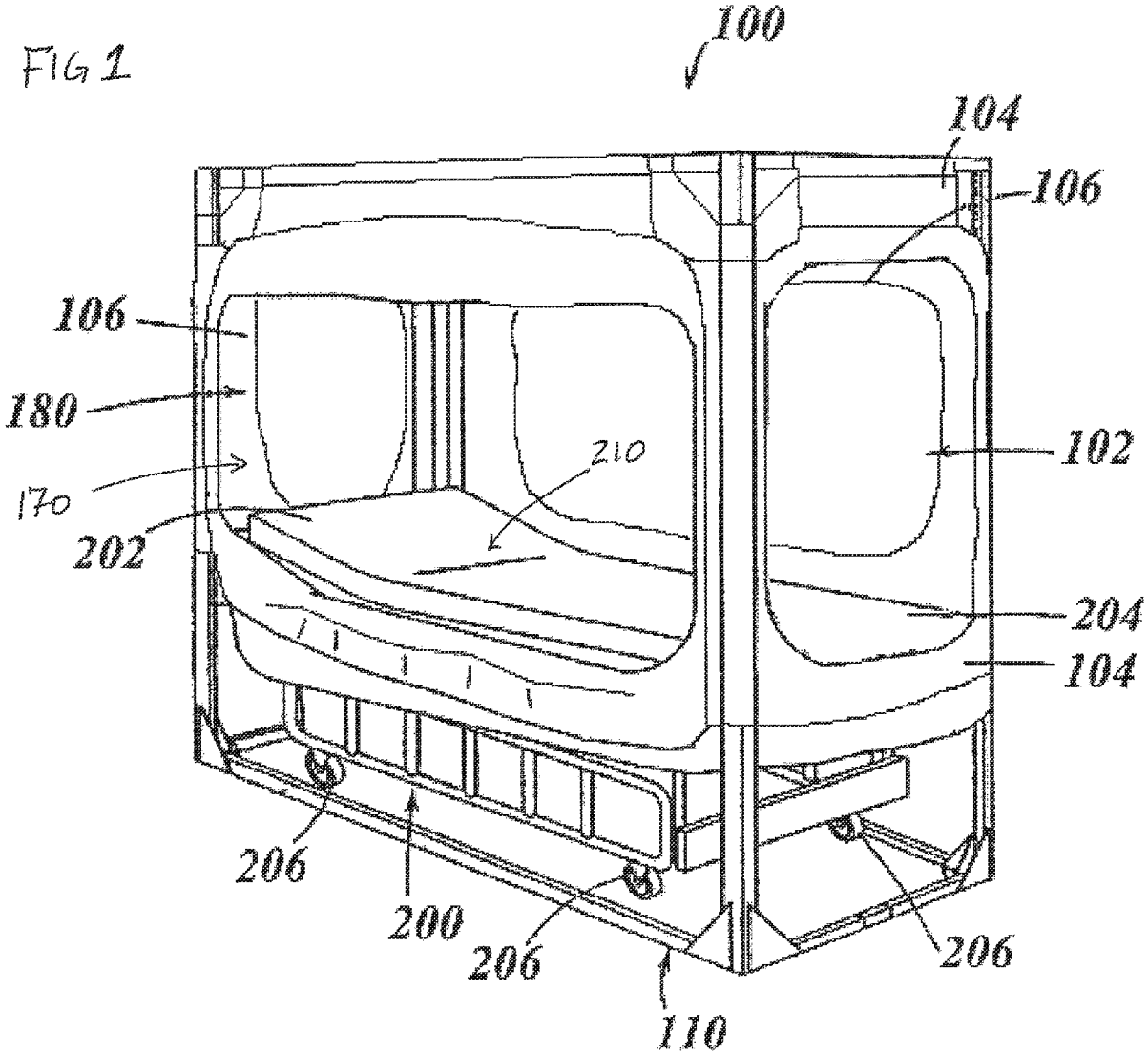
FIG. 1 schematically illustrates an enclosure for a bed positioned about a bed.

The present invention overcomes many of the prior art problems associated with enclosures for restraining or isolating patients to a bed area. The advantages, and other features of the invention disclosed herein, will become more readily apparent to those having ordinary skill in the art from the following detailed description of certain embodiments taken in conjunction with the drawings that set forth representative embodiments of the present invention and wherein like reference numerals identify similar structural elements.

FIG. 1 schematically shows an enclosure having a frame and a canopy. Enclosure 100 is configured to confine a person to a bed 200 without restraints. Typically, the enclosure 100 can be used in a hospital environment with a hospital bed. The enclosure 100 has a frame 110 that defines an area of restraint about the bed 200. The frame 110 can be fabricated from a variety of materials now known and later developed such as steel, PVC pipe, aluminum, plastics, carbon fiber composite, other metals, materials, and the like, alone or in combination, to create a suitably robust and/or lightweight frame 110.

A canopy assembly 102 is draped about the frame 110 and secured thereto to prevent a person from leaving the area of restraint 180. An opening 170 in the canopy 102 leaves access to a portion of the bed 200 for adjustment of the bed within the enclosure 100. The canopy 102 can be secured in place on or over the frame 110 by zippers, fabric sleeves or collars which slide over or wrap around the frame components, complementary hook and loop fasteners (Velcro™) snaps, ties, and the like, or combinations thereof as would be appreciated by those of ordinary skill in the art based upon review of the subject disclosure.

The canopy 102 can be fabricated from a combination of vinyl and/or nylon portions 104 and netting 106, such as, e.g., black nylon netting. Dark colors, such as black, brown, blue and the like, allow for improved see-through capability and greater stain resistance. Further, nylon material is substantially lighter than vinyl and therefore easier to handle. However, those skilled in the art will appreciate that other materials or configurations of the canopy may be used without departing from the scope of this disclosure.

Figure 2:
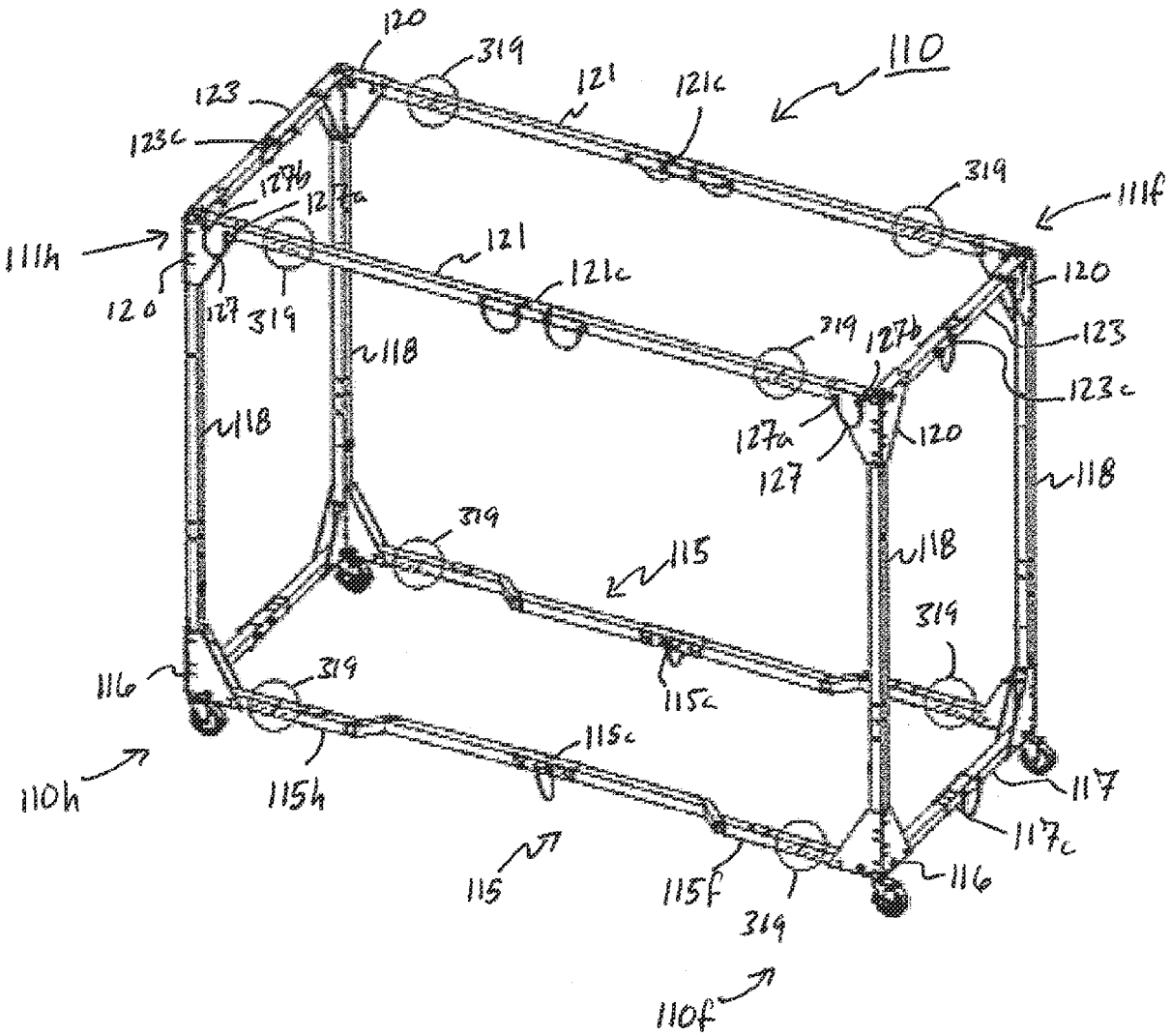
FIG. 2 illustrates an adjustable frame to be used for an enclosure.

FIG. 2 shows an adjustable frame to be used for an enclosure. Referring to FIG. 2, the frame 110 includes a top, or eave portion 111, supported above a bottom, or base portion 113, by upstanding supports 118. When assembled, the frame 110 is sufficiently rigid to support itself on the floor or other base by the base portion 113. A bed 200 to be placed within the enclosure 100 has a head 202 and a foot 204 (see FIG. 1); thus, the frame 110 has a corresponding head end 110*h* and foot end 110*f*, respectively; although the frame 110 as shown is symmetrical, these references are made merely for descriptive purposes. In other embodiments, the frame is not symmetrical, as may be desirable due to use conditions, e.g., the construction of the bed. The strength and stability of the frame 110 may be made according to known techniques such that an adult could robustly attempt exit without damage to the frame 110 or tipping the frame 110 over, or compromising the integrity of the enclosure.

As shown in FIG. 2, the base portion 113 has lower supports 115, each lower support 115 having a head portion 115*h* toward the head 202 of the bed 200 and a foot portion 115*f* toward the foot 204 of the bed 200. The head portion 115*h* and the foot portion 115*f* are linked by a coupling 115*c*. Two lower transverse supports 117 extend between the lower supports 115 to form substantially a rectangle approximately the size of, or slightly larger than, the bed 200. As will be appreciated, though, the base portion may be constructed with any manner, number, and shape of the members to define any desired shape. Traditionally, a standard hospital bed is approximately a standard size, although it should be appreciated that the enclosure 100, in particular the rectangle formed by the base portion 113 and eave portion 111, as discussed herein, is well-suited to adaptation to beds of any size. Moreover, even beds of a standard size may have bed rails that extend beyond the length of the bed, such that additional room at the head or foot of the bed is required to fully utilize the bed rails, particularly when a patient is entering or exiting the bed.

Lower corner brackets 116 (four in the case of a rectangular shape or four frame members) secure the lower supports 115 and lower transverse supports 117 of the base portion 113 in such a manner that both lower supports 115, 117 can selectively rotate upwards at the lower corner brackets 116. Accordingly, each bracket 116 can have a pivot or pivot construction in a known manner that allows for the selective upward rotation of the lower supports 115, 117. Further, each coupling 115*c* may provide a rotational pivot in the middle of lower support 115 such that the frame 110 may be folded and/or collapsed for storage, transport, or other purpose.

As shown, the eave portion 111 is supported above the base portion 113 by upstanding supports 118. Upper supports 121 extend between a head end 111*h* and a foot end 111*f* of the eave portion 111. Upper transverse supports 123 extend between the upper supports 121 to form a shape substantially the same as the shape formed by the base portion 113, here, substantially a form of a rectangle approximately the size of, or slightly larger than, the bed 200. As will be appreciated, like the base portion, the eave portion 111 may be constructed to form any desired shape, even one different from the base portion 113. Upper corner brackets 120 (e.g., four in the case of a rectangular shape) secure the upper supports 121 and the upper transverse supports 123 of the eave portion 111.

Similar to the construction of lower supports 115, 117, upper supports 121, 123 may include pivots or pivot constructions (brackets 120 and coupling 121*c*) that allow for selectively folding the upper supports 121, 123, albeit downwardly instead of upwardly. Further, as shown in FIG. 2, the central region of each lower support 115 (coupling 115*c*) of the base portion 113 is offset toward the interior of the frame 110 for facilitating collapsing the enclosure 100 as well. The offset allows the lower support 115 to selectively rotate upward and/or fold upward to allow for collapse of the enclosure 100 without interference between the lower support 115 and the upper support 121 when folded at an upper coupling 121*c*, thereby minimizing the space the enclosure 100 occupies when in a storage state. Accordingly, the offset allows the collapsed enclosure 100 to occupy less space than may otherwise be required for storage. Alternatively, the offset can be outward or upper supports 121 may include an offset, or no offset may be used. Alternatively still, the couplings 115*c*, 121*c* may be offset relative to each other thereby obviating the need for an offset of the supports 115, 121. Although described and shown herein that all elements of the frame, including the support elements, have a square shape or cross-section, the elements of the frame may have any shape or cross-section, e.g., triangular, rectangular, circular, oval, or other shapes and dimensions.

Still referring to FIG. 2, when assembled, the corner brackets 116 and 120 detachably secure the upstanding supports 118 with the lower (115/117) and upper (121/123) supports. As described above, lower (115/117) and upper (121/123) supports may be selectively rotatable within the brackets 116 and 120. Accordingly, a securing means 127, such as a pin or other locking mechanism may be employed to lock or secure lower (115/117) and upper (121/123) supports to form the frame without collapsing. In addition, in the illustrative embodiment, the securing means 127 includes two pins 127*a*, 127*b*, one of which acts as the pivot for the respective lower supports 115, 117, and upper supports 121, 123, the other that acts to prevent rotation of the frame member about its respective pivot. In alternative embodiments, the upstanding supports 118 may be integral with the corner brackets 116 and 120. Still in other embodiments, the supports 121, 123 of the eave portion 111 may each be formed of a single piece, such as a monolithic structure, and selectively detach from the corner brackets 116 and 120 for partial disassembly. In other embodiments, only the supports of the eave portion 111 (121, 123) or base portion 113 (115, 117) may include pivoting couplings 121*c* or 115*c*, respectively, or similar coupling, and thus the frame 110 may be partially collapsible. Moreover, the base portion 113 may be omitted entirely, and the frame may be supported by the floor or other means.

As illustrated in FIG. 1, the bed 200 is mounted on wheels or casters 206, and the bed 200 can be rolled into the enclosure 100 without interference by removal of any of the base portion supports 115, 117, or may roll over base portion supports 115, 117. A mattress 210 is located on the bed 200, the patient may be placed in the enclosure 100, and the canopy 102 can be secured in place. Alternatively, the canopy 102 may be secured in place about the frame 110 and the patient may enter the restraining area through an open panel 170 of the canopy 102. In an alternative embodiment, there may be no base portion 113. In one such embodiment without a base portion 113, the upstanding supports 118 may terminate in foot plates that rest on the floor. In another embodiment, the upstanding supports 118 may terminate in a post adapted and configured for insertion in headboard slots and footboard slots of the bed 200, such as is common on a hospital bed. Thus, to erect the enclosure 100 about the bed 200, the headboard and footboard are removed and the upstanding supports 118 may be inserted therein. Alternatively, the upstanding supports 118 may bolt onto a bed or an adapter plate to facilitate secure locking engagement to the bed.

As noted, frame 110 is an adjustable frame. As shown in FIG. 2, the frame 110 includes expansion joints 319, 115*c*, 117*c*, 121*c*, 123*c*, herein after referred to as expansion joint 319. These expansion joints, of which expansion joint 319 is explained below, but expansion joints 115*c*, 117*c*, 121*c*, 123*c* are similarly constructed, facilitate adjustment of the frame 110 in a length direction, or alternatively, in the width direction (not shown). The upper supports 121 and lower supports 115 may each include expansion joints to allow for adjustment of the supports 115, 121 in a length direction. The upper supports 123 and lower supports 117 may each include expansion joints to permit width adjustment. The expansion joints allow for the frame 110 to expand or extend (first length/width) to a first position of the frame, and to retract or shorten (second length/width) to a second position of the frame, as detailed herein.

Figure 2B:
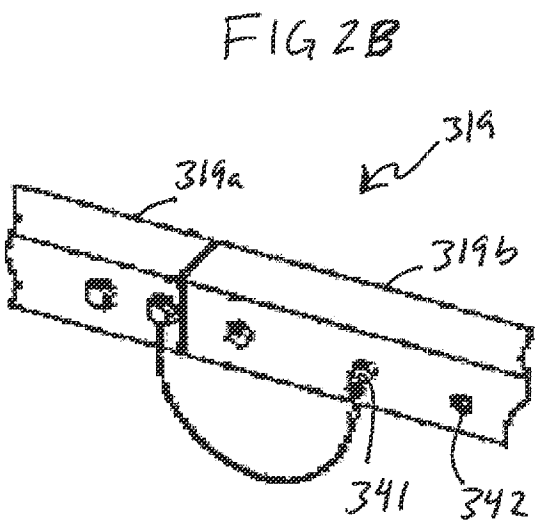
FIG. 2B illustrates an adjustable frame portion in a second position of the enclosure of FIG. 2.
Figure 2A:
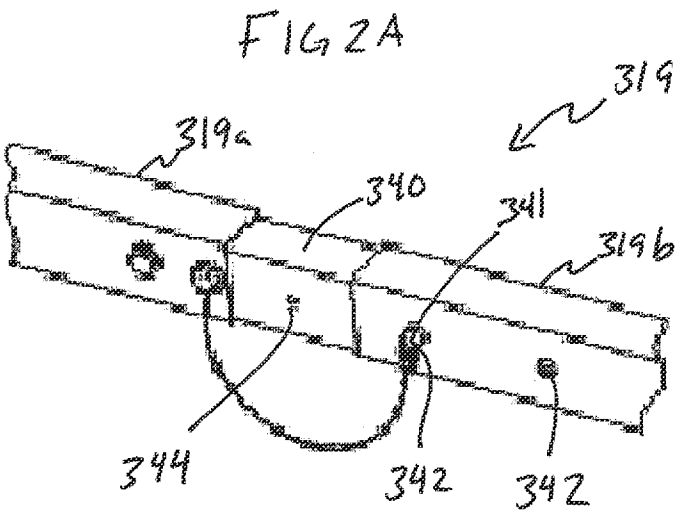
FIG. 2A illustrates an adjustable frame portion in a first position of the enclosure of FIG. 2.

Referring now to FIGS. 2A and 2B, an exemplary expansion joint 319 is shown. FIG. 2A shows the expansion joint 319 as expanded or extended (first length) corresponding to the first position of the frame, and FIG. 2B shows the expansion joint 319 as retracted or shortened (second length) corresponding to the second position of the frame. As shown, the first length is an extension in length of the expansion joint 319. Expansion joint 319 is part of a support, e.g., as shown in FIG. 2, part of upper support 121 and/or lower support 115. As shown in FIGS. 2A and 2B, the support includes support elements 319*a* and 319*b*. The expansion joint 319 facilitates adjustment of the length of the support. In FIGS. 2A and 2B, the expansion joint 319 is formed with a separation and two support elements 319*a* and 319*b*. When the support elements 319*a*, 319*b* are at the shortest length (second length or second position of the frame), the elements 319*a* and 319*b* are touching, as shown in FIG. 2B. However, when the expansion joint 319 is expanded (to the first length or first position of the frame), the elements 319*a* and 319*b* are separated, as shown in FIG. 2A. Although shown with two lengths, those skilled in the art will appreciate that any number of lengths or dimensions may be accommodated without departure from the invention.

As shown in FIG. 2A, the expansion of the support elements 319*a*, 319*b* is facilitated by use of a splice bar 340 located within the support elements 319*a*, 319*b*. The splice bar 340 allows for structural integrity of the support elements 319*a*, 319*b* to not be affected, or not be significantly affected, such that the support elements 319*a*, 319*b* can provide structure, support, and/or rigidity to the frame. The splice bar 340 is an insert within the structure of the support elements 319*a*, 319*b*. Accordingly, the splice bar 340 is a structural bar or element with a diameter or dimension that is smaller than the diameter or dimension of the support elements 319*a*, 319*b*. As such, the splice bar 340 may be contained within the support elements 319*a*, 319*b*. When the expansion or extension of the support elements 319*a*, 319*b* is desired, the supports elements 319*a* and 319*b* may be pulled apart, with splice bar 340 maintaining the structure and rigidity of the frame. For example, the splice bar 340 may provide a telescoping aspect to support elements 319*a*, 319*b*, allowing for an extension/expansion and separation thereof.

To engage the support elements 319*a*, 319*b* with the splice bar 340, the support elements 319*a*, 319*b* have holes 342 and the splice bar 340 has a corresponding hole(s) 344 to accommodate a locking mechanism 341, such as a pin or bolt or other type of locking mechanism. The locking mechanism 341 allows for the adjustment of the support elements 319*a*, 319*b* to be adjusted to an appropriate length and then locked in place with locking mechanism 341 such that the expansion joint 319 does not further adjust when in use, one should also note that with locking mechanism 341 removed, the frame elements can be completely separated at that location for disassembly of the frame 110.

FIG. 2A shows the splice bar 340 located in support elements 319*a*, 319*b* and serves as part of the expansion joint 319 to be used in upper support 121 and/or lower support 115. In alternative embodiments, the expansion joint 319 can be configured as a telescoping bar, overlapping plates, rigid sleeves, or other means for expansion that are known or will become known, without departing from the scope of the disclosure. Another configuration of the expansion joint may be that one of the elements of the support may be tapered to fit within the other element of the support, such that an independent element may not be necessary. Alternatively, the splice bar 340 may be integral with one of the elements 319*a*, 319*b*, forming a reduced size/diameter portion of its respective elements to fit within the other element. In yet other embodiments, the splice bar 340, whether separate from or integral with the elements(s) can be larger than the elements, such that the elements(s) fits inside the splice bar 340, e.g., the splice bar 340 forms a sleeve. Furthermore, expansion joints similar to expansion joint 319 can be used in lower transverse supports 117 and/or upper transverse supports 123 of the embodiment shown in FIG. 2 and can allow for expansion of the bed frame in the width direction. Further, expansion joints as described herein may also be used in upstanding supports 118 to enable adjustment of the enclosure in a vertical direction. FIGS. 2A and 2B show how the splice bar, and therefore support can be adjusted by a user.

Figure 3:
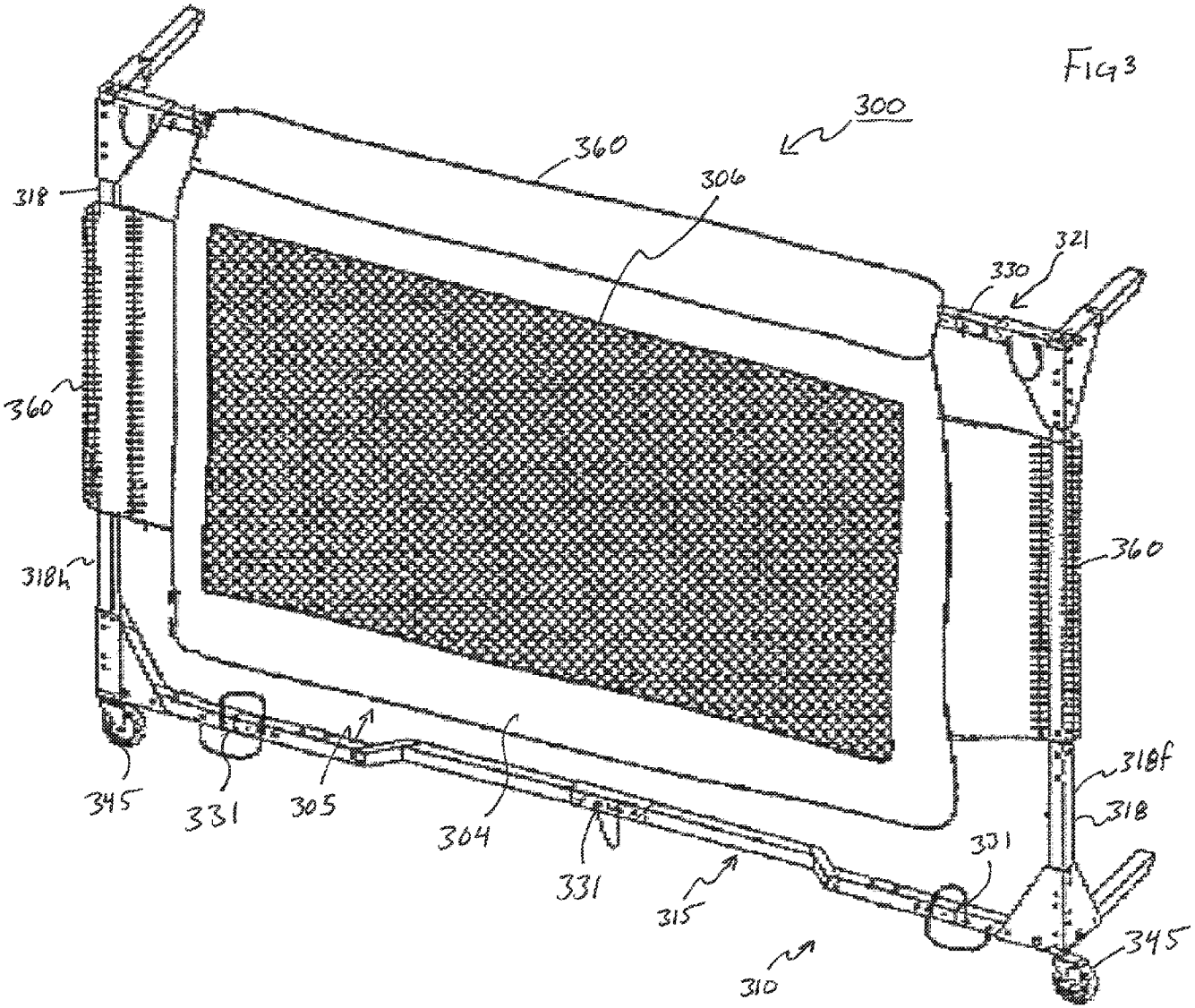
FIG. 3 illustrates an adjustable enclosure panel attached to the adjustable frame of FIG. 2 in a first position.
Figure 4:
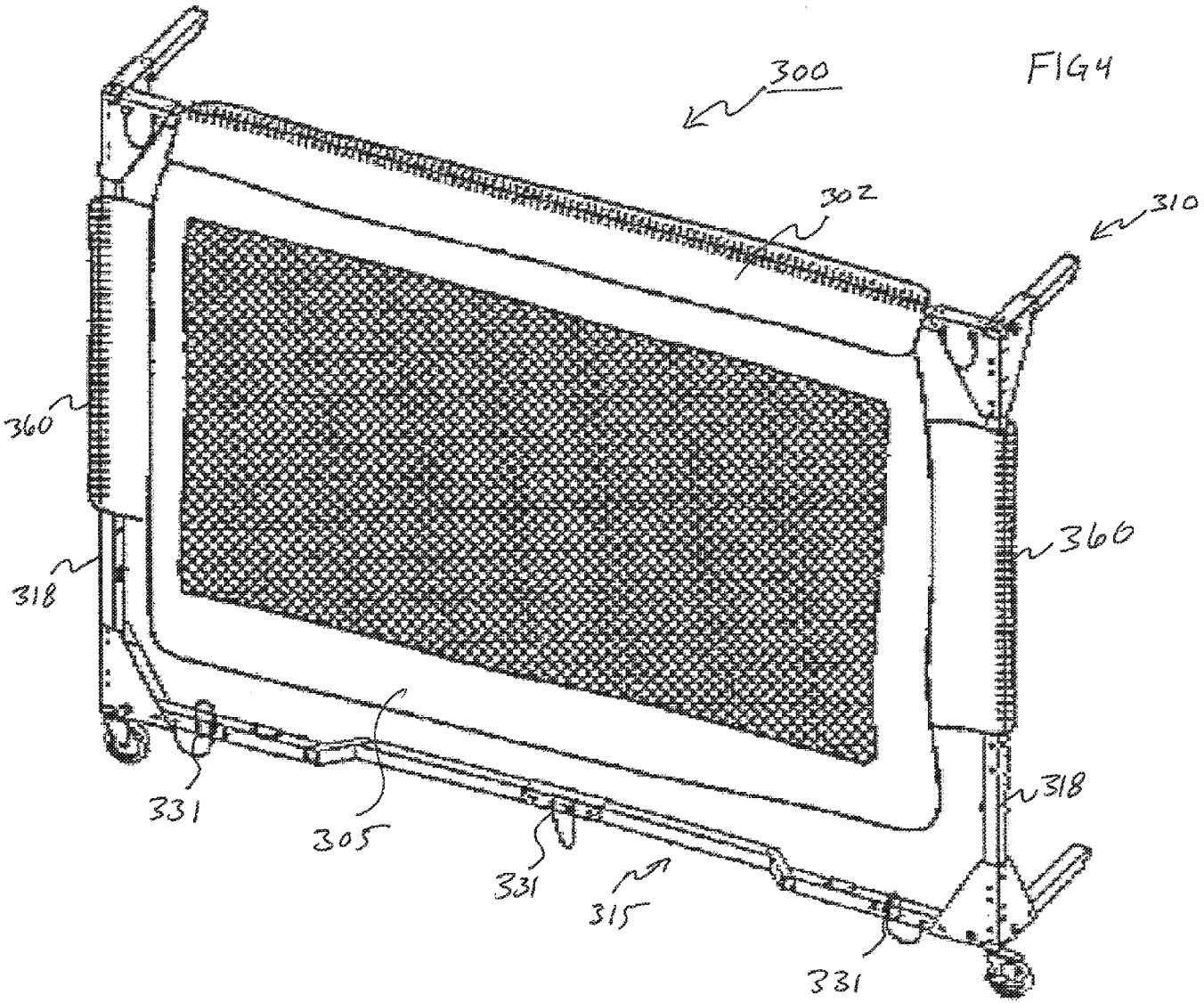
FIG. 4 illustrates the adjustable enclosure panel of FIG. 3 in a second position.

Referring now to FIG. 3, a partial view of an adjustable frame 310 and an adjustable canopy 302 of an enclosure 300 are shown in an expanded, extended, or larger configuration, hereinafter referred to as a first position of the enclosure 300. FIG. 4 shows the enclosure 300 in a second position. The second position is a retracted or smaller configuration of enclosure 300. The adjustable frame 310 is substantially similar to the frame 110. The adjustable frame 310 includes an upper support 321 supported above a lower support 315 of a base portion by upstanding supports 318. Each upstanding support 318 is coupled to an end of the upper support 321. For example, a first upstanding support 318*h* is coupled at a first end 321*h* of the upper support 321, and a second upstanding support 318*f* is coupled at a second end 321*f* of the upper support 321. The upstanding supports 318, as shown, are also each coupled to a lower support 315. In an alternative embodiment, the lower support 315 may be omitted, and the upper laterally extending support 321 may be supported by the upstanding supports 318 over a floor or attached to a bed frame, as discussed above. Further, as shown in FIG. 3, the frame 310 includes wheels or casters 345 that facilitate the enclosure 300 to be moveable from one location to another, e.g., with the patient in the enclosure, or to install the enclosure 300 about a bed.

As shown in FIGS. 3 and 4, the first position of the enclosure 300 employs collars 360 in an expanded position of the canopy 302 and supports 315/321 of the frame 310, and the second position of the enclosure 300 employs the collars 360 of the canopy 302 and supports of the frame 310 in an unexpanded position. The collars 360 are part of or attached to panels 305, as described herein. Accordingly, the components of the enclosure 300, the frame 310 and canopy 302 are adjustable between at least a first and a second position. The first position (FIG. 3) is an expanded state or larger configuration, and the second position (FIG. 4) is a retracted state or smaller configuration. The frame 310 and canopy 302 are adjustable to allow for transitioning between the first position and the second position. The frame elements may expand and retract in length in the length direction of the frame elements (along the length of a support element) by means of an expansion joint, as described with respect to FIGS. 2, 2A, and 2B. The canopy assembly may expand and retract by adjustment of the panels of the canopy assembly by means of adjustable collars. The expansion and retraction of the panels is achieved through adjustment of a collar attached to, or part of, the panels. Specifically, as shown, the length of the enclosure 300 is made shorter, such that the distance between the upstanding supports 318 is less in FIG. 4 than it is in FIG. 3. This adjustment is achieved by adjusting the length of the upper support 321, the length of the lower support 315, and adjusting the circumference of the collar(s) 360, as described herein.

To facilitate the adjustability of the frame 310, the upper support 321 includes one or more expansion joints 330, substantially similar to expansion joints 319, 115*c*, 117*c*, 121*c*, 123*c*, such that the upper support 321 is adjustable in a length direction of the upper support 321 between at least a first length, corresponding to the first position of the enclosure 300, and a second length, corresponding to the second position of the enclosure 300. The lower support 315, when included, also includes one or more expansion joints 331, substantially similar to expansion joints 319, 115*c*, 117*c*, 121*c*, 123*c*, such that the lower support 315 is adjustable in a length direction of the lower support 315 between at least a first length and a second length, corresponding to the first and second lengths of the upper support 321 and first and second positions of the enclosure 300. In such manner, the length of the frame 310, and therefore enclosure 300, can be adjusted to accommodate different length beds. Similarly, supports extending in the width direction of the frame may be adjustable to accommodate different width beds, as described above. Specifically, a width extending support may include an expansion joint similar to expansion joints 319, 115*c*, 117*c*, 121*c*, 123*c* to facilitate width expansion of the frame. Moreover, the upstanding supports 118 may also include expansion joints similar to expansion joints 319, 115*c*, 117*c*, 121*c*, 123*c* to facilitate adjustment in the vertical direction.

As shown in FIG. 3 a portion of an adjustable canopy assembly 302 is shown installed on the adjustable frame 310. The adjustable canopy assembly 302 includes panels 305, including, for example, a combination of vinyl or nylon portions 304 and netting 306. Although discussed herein with respect to the embodiments shown in FIGS. 3-6, those skilled in the art will appreciate that other constructions of the panels 305 are useable without departing from the scope of the present invention.

To facilitate the adjustability of the canopy, along with the adjustable frame described herein, as shown in FIG. 3, the adjustable canopy assembly 302 includes a plurality of collars 360 that are configured to removably connect the adjustable canopy assembly 302 to the upper support 321 and the upstanding supports 318. In an alternative embodiment, the collars or other elements may connect and/or attach to the lower support 313, to provide a completely sealed enclosure, or similar structure. As shown, the collars 360 wrap around the upstanding supports 318 and the upper support 321. The panel 305 is attached to the plurality of collars 360 such that the panel 305 is held substantially in a plane defined by the upper support 321 and the upstanding supports 318. As such, the panel 305 is suspended from the frame 310 substantially in a plane of the frame, and substantially defines a wall of an enclosed space that is enclosed by the frame 310, e.g., enclosing the area within the enclosure 300.

Figure 5A:
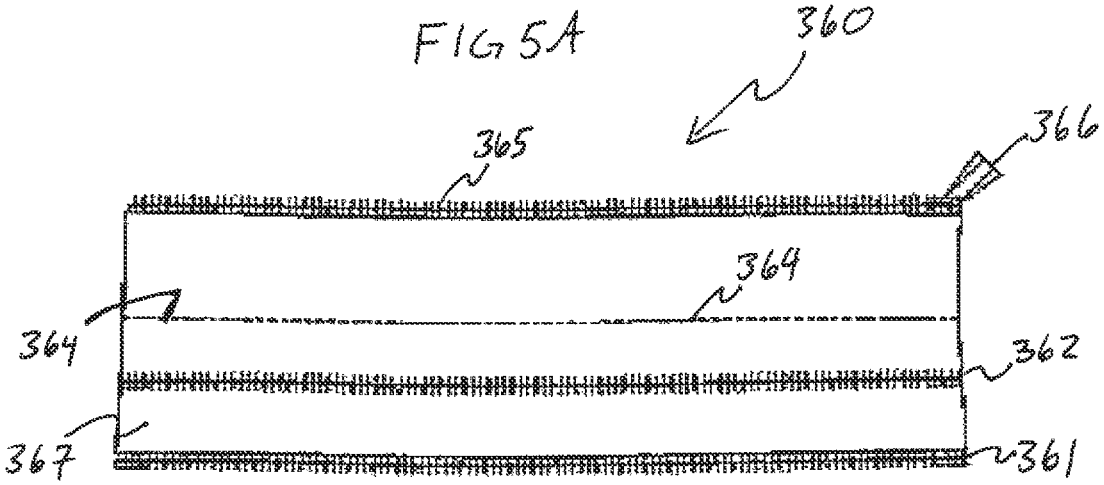
FIG. 5A illustrates an embodiment of the adjustable collar in an open and flat position.
Figure 5B:
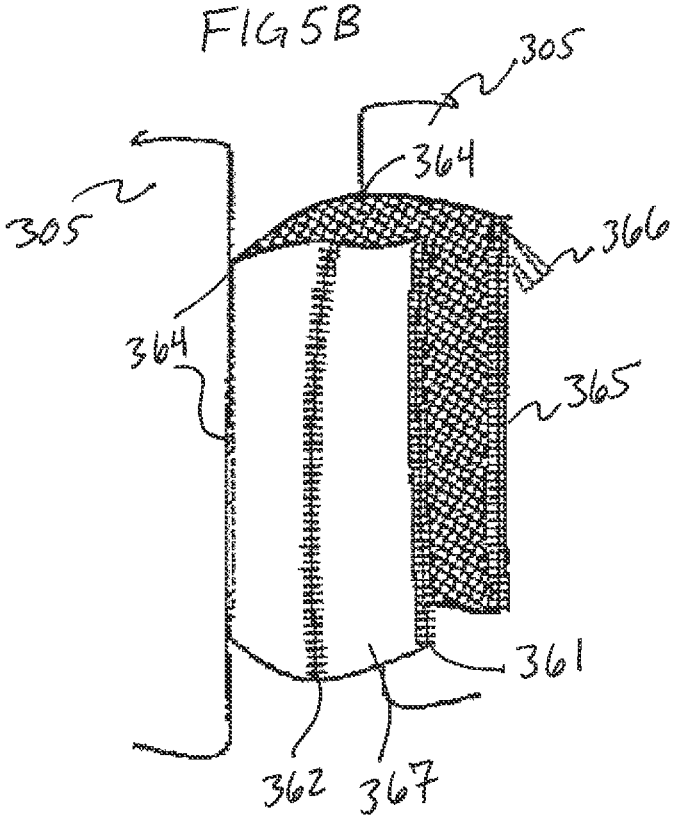
FIG. 5B illustrates the adjustable collar as attached to panels and in an open position.

An expandable collar 360 having fasteners or connectors, herein zippers 361, 362, and 365, as shown in FIGS. 5A and 5B, are configured to removably connect the panel 305 to the frame 310. FIGS. 5A and 5B show how a user can adjust the collars 360 of the enclosure, and thereby adjust the size, shape, or configuration of the canopy assembly. FIG. 5A shows the collar 360 as opened, expanded, or laid flat. Zipper 365 is a set of zipper teeth that allow for selective zipping engagement between zipper 365 and each of first zipper 361 and second zipper 362. Zippers 361, 362 are selectively connected (zipped) to zipper 365 using a zipper pull 366 in a known fashion. A collar extension 367 is disposed between the first zipper 361 and the second zipper 362. The collar extension 367 is fabric or other material that allows the collar 360 to expand to different sizes or circumferences for removable connection to the upstanding supports 318. The collar extension 367 may be a section of fabric or may be a pleated material, allowing for different means of expanding the collar 360. Other forms of collar extension may be used without departing from the scope of this disclosure. For example, elastic material may be used for the collar extension 367. The first zipper 361 provides a larger first circumference collar 360 when connected with the zipper 365 that corresponds to the first position of enclosure 300. The second zipper 362 provides a smaller second circumference collar 360 when connected to the zipper 365 and corresponds to the second position of the enclosure 300. Although described and shown herein as a set of zippers (361, 362, 365), the zippers may, alternatively, be in the form of any fastener or connecting means, such as zippers, ties, complementary hook and loop fasteners (Velcro™), snaps, or other forms of fasteners known or will become known.

The collar 360 is attachable to a panel 305 along attachment line 364. Line 364 may be a sew line, such that collar 360 is sewn to the panel 305, as shown in FIG. 5B. The collar may be sewn to more than one panel 305, such that the canopy assembly 302 can be attached to a complete frame structure, as shown in FIGS. 1 and 2. To connect the collar 360 to the panel 305, zippers, snaps, ties, complementary hook and loop fasteners (Velcro™), and/or other means of connecting may alternatively be used or the collar 360 may be of a continuous fabric or piece with the panel 305.

Similar in function to the expansion joints used in the extension of the frame, the adjustable collars allow for multiple lengths, dimensions or circumferences of the panel 305. Accordingly, when the frame 310 is adjusted in size or dimension, the panel 305 may also be adjusted in size or dimension.

Figure 6A:
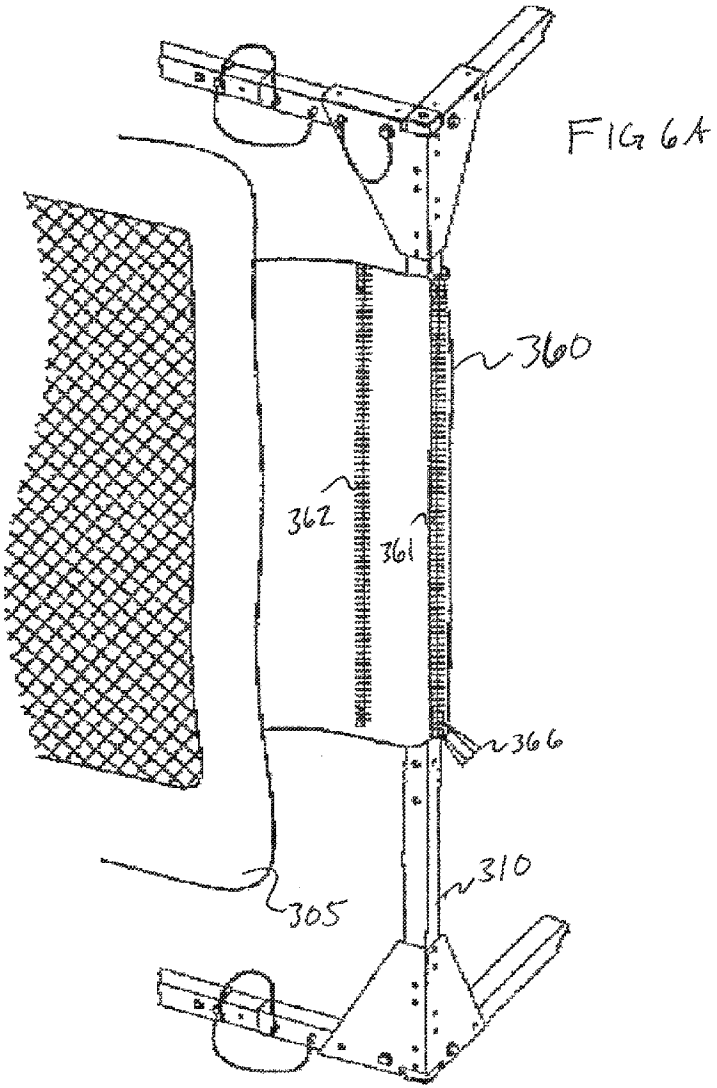
FIG. 6A illustrates an adjustable collar of the adjustable enclosure in the first position of FIG. 3.
Figure 6B:
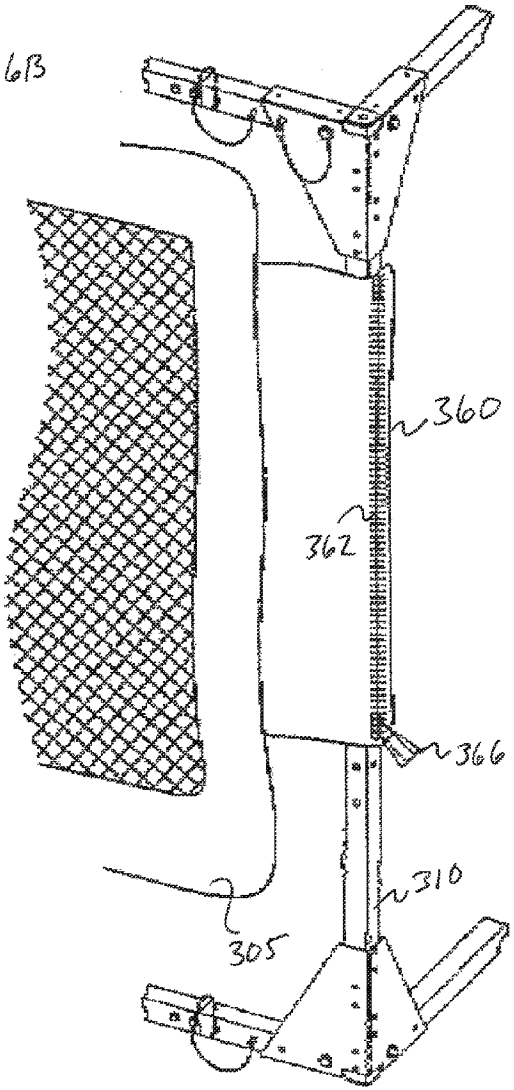
FIG. 6B illustrates an adjustable collar of the adjustable enclosure in the second position of FIG. 4.

A use of the adjustable collar(s) 360, as is shown in detail in FIGS. 6A and 6B, and as could be used in a method of adjusting the canopy assembly and frame disclosed herein. Referring now to FIG. 6A, a close up view of the collar 360 connected to the upstanding support 318, of FIG. 3, is shown. As described, the zippers 361 and 362 allow for the size of the collar to be adjusted and therefore adjust the length, size, or dimension of the panel 305. In FIG. 6A, a large first size is achieved corresponding to the first position of the enclosure 300, to accommodate for the longer length of supports 321/315, and employs the first circumference of collar 360 utilizing zipper 361. This allows for an extension of the canopy assembly 302, such that a longer bed or more room may be accommodated within the enclosure 300. FIG. 6B shows the collar 360 in a second size using zipper 362, that is smaller than the first circumference corresponding to a smaller dimensioned panel (second position of the enclosure 300).

The adjustable collar(s) 360 can have additional fasteners such that the collar(s) 360 can be adjustable as desired. Further, a lockable drawstring-type configuration may be used for essentially continuous adjustment to the collar(s)/panel(s) size, to, e.g., minimize gaps between the panel and the frame elements. Moreover, collars that attach at the top and bottom of the frame may also be used at the top and bottom of the canopy such that the panel is expandable/adjustable in height, to accommodate different frames, or to be adjusted with an adjustable frame in height.

In view of the above, when operated in conjunction, the adjustable frame 310 and the adjustable canopy assembly 302 are adjustable between various dimensions, to accommodate for different length and/or width beds that may need to be enclosed, and/or to accommodate for bed rails that may need additional room or space to operate.

As will be recognized by those of ordinary skill in the pertinent art based on the teachings herein, the illustrated canopy assemblies are usable with any of numerous different types of frames that are currently known, or that later become known. For example, the canopies may be used with frames that are collapsible, non-collapsible, or that are adjustable in size. In addition, the canopy assemblies equally may be usable with frames that are not foldable or otherwise collapsible, but rather are fixed in position and moved whole, or require the fixedly secured parts of the frame to be disassembled to transport or store the enclosure.

As described, one or more supports or upstanding supports of the adjustable frame may be telescopic with securing elements for enabling the frame to be adjustably sized as desired to accommodate different sized beds (e.g., infant, toddler, twin, full, queen, and king sized beds). Such telescopic supports may be employed either in a collapsible frame or in a non-collapsible frame. Further, although described herein as having a first and second position, and therefore only two sizes, those of skill in the art will appreciate that the frame (and enclosure) may be configured to have many dimensions in length, width, and height, and therefore the above disclosure merely provides examples. For example, the adjustment of the splice bar of embodiments described herein may allow for more than two adjustable positions of the support bars. Such non-collapsible frames may be mounted on the floor surrounding the bed as illustrated in FIG. 1, may be fixedly secured to the bed frame and movable therewith on, for example, via casters on the bed, may be mounted on the bed frame to form a combined bed and enclosure frame, or may be mounted on means for transporting the frame with or without the bed, such as wheels, casters, bearings or other devices for rolling, sliding or otherwise transporting the frame that are currently known, or that later become known. Such frames also may be modular, such that separable frame modules or sub-assemblies can be disassembled from each other to transport or store the frame.

In addition, the canopy may define a sealed enclosure for isolating a patient therein, wherein a base wall of the canopy overlies the bed, and if desired, the mattress of the bed, to prevent contamination of the bed and mattress, and wherein the canopy and frame are transportable with the bed to transport the patient within the enclosure from one location to another. Further, although described herein with only two adjustable zippers, this is merely for illustrative purposes, and those skilled in the art will appreciate that many zippers or fastening mechanisms may be used with the collars and panels of the canopy to allow for various sizes, lengths, and dimensions of the canopy without departing from the scope of the present disclosure.

As would be appreciated by those of ordinary skill in the pertinent art upon review of the subject disclosure, the figures and associated detailed description are representative of embodiments of the invention and various modifications can be made thereto. While the invention has been described with respect to certain embodiments, those skilled in the art will readily appreciate that various changes and/or modifications can be made to the disclosed embodiments without departing from the spirit or scope of the invention as disclosed herein and as claimed.

What is claimed is:

1. An enclosure for enclosing an area, the enclosure comprising:

a frame adapted to be positioned about an area, the frame comprising:

an upper laterally extending support;

a first upstanding support coupled to a first end of the upper laterally extending support; and a second upstanding support coupled to a second end of the upper laterally extending support, wherein the upper laterally extending support is adjustable in a length direction of the support between at least a first position and a second position; and a canopy assembly connectable to the frame for defining an enclosed area, the canopy comprising:

a plurality of collars configured to removably connect the canopy to the upper laterally extending support, the first upstanding support, and the second upstanding support; and at least one panel coupled to the plurality of collars such that the panel is held in a plane defined by the upper laterally extending support, the first upstanding support, and the second upstanding support, wherein at least one of the plurality of collars is adjustable between a least a first circumference and a second circumference, wherein at least one adjustable collar comprises a fastener comprising a first connector and a second connector, and a collar extension attached to, disposed between, and extending in substantially the same direction as the first connector and the second connector;

wherein, when the upper laterally extending support is adjusted from the first position to the second position, at least one of the plurality of adjustable collars attached to one of the first upstanding support or the second upstanding support is correspondingly adjustable from the first circumference to the second circumference for said collar to be connected to said at least one of the first upstanding support and the second upstanding support.

2. An enclosure according to claim 1, further comprising a lower laterally extending support opposing the upper laterally extending support, wherein the lower laterally extending support is adjustable in a length direction of the support between at least the first position and the second position.

3. An enclosure according to claim 1, wherein the upper laterally extending support comprises an expansion joint configured to expand the upper laterally extending support from the first position to the second position.

4. An enclosure according to claim 3, wherein the expansion joint comprises a telescoping bar.

5. An enclosure according to claim 3, wherein the expansion joint comprises a splice bar.

6. An enclosure according to claim 3, wherein the expansion joint comprises at least two overlapping plates.

7. An enclosure according to claim 1, wherein the first connector and the second connector define a third position and a fourth position, respectively; and wherein, when the upper laterally extending support is in the first position, the adjustable collar is placeable in the third position for said collar to be connected to said at least one of the first upstanding support and the second upstanding support, and when the upper laterally extending support is in the second position, the adjustable collar is placeable in the fourth position for said collar to be connected to said at least one of the first upstanding support and the second upstanding support, and wherein the third position corresponds to the first circumference and the fourth position corresponds to the second circumference.

8. An enclosure according to claim 7, wherein in the third position the first and second connectors are connected to each other and the collar extension is retracted, and in the fourth position the first and second connectors are disconnected from each other and the collar extension is extended.

9. An enclosure according to claim 7, wherein the fastener comprises a zipper and the first connector is a first set of zipper teeth and the second connector is a second set of zipper teeth.

10. An enclosure according to claim 7, wherein the fastener comprises complementary hooks and loops (Velcro) and the first connector is a panel of hooks and the second connector is a panel of loops.

11. An enclosure according to claim 7, wherein the fastener comprises a third connector and:

the first connector defines a first location on the collar, the second connector defines a second location on the collar, and the third connector is configured to connect to the first connector in the third position and to connect to the second connector in the fourth position.

12. An enclosure according to claim 1, wherein the enclosure is configured to enclose a bed.

13. An enclosure for enclosing an area, the enclosure comprising:

a frame adapted to be positioned about an area, the frame comprising:

an upper laterally extending support;

a first upstanding support coupled to a first end of the upper laterally extending support; and a second upstanding support coupled to a second end of the upper laterally extending support, wherein the upper laterally extending support is adjustable in a length direction of the support between at least a first position and a second position; and a canopy assembly connectable to the frame for defining an enclosed area, the canopy comprising:

a plurality of collars configured to removably connect the canopy to the upper laterally extending support, the first upstanding support, and the second upstanding support; and at least one adjustable panel coupled to the plurality of collars such that the panel is held in a plane defined by the upper laterally extending support, the first upstanding support, and the second upstanding support, wherein the at least one adjustable panel comprises a fastener comprising a first connector and a second connector, and a panel extension attached to, disposed between, and extending in substantially the same direction as the first connector and the second connector; and wherein, when the upper laterally extending support is adjusted from the first position to the second position, the at least one adjustable panel is correspondingly adjustable from a first length to a second length for at least one of the plurality of collars to be connected to at least one of the first upstanding support and the second upstanding support.

14. An enclosure according to claim 13, wherein the first connector and the second connector define a third position and a fourth position; and wherein, when the upper laterally extending support is in the first position, the adjustable panel is placeable in the third position for said at least one of the collars to be connected to said at least one of the first upstanding support and the second upstanding support, and when the upper laterally extending support is in the second position, the adjustable panel is placeable in the fourth position for said at least one of the collars to be connected to said at least one of the first upstanding support and the second upstanding support, and wherein the third position corresponds to the first length and the fourth position corresponds to the second length.

15. An enclosure for enclosing an area, the enclosure comprising:

a frame adapted to be positioned about an area, the frame comprising:

first means for supporting and for adjusting in length between at least a first position and a second position;

a first upstanding support coupled to a first end of the first means; and a second upstanding support coupled to a second end of the first means; and a canopy assembly connectable to the frame for defining an enclosed area, the canopy comprising:

second means for removably connecting the canopy to the first means, the first upstanding support, and the second upstanding support;

third means for coupling to the second means such that the third means is held in a plane defined by the first means, the first upstanding support, and the second upstanding support; and fourth means attached to, and extending in substantially the same direction as, one or more of the second means or third means, for adjusting from a third position to a fourth position, and wherein, when the first means is adjusted from the first position to the second position, the fourth means is correspondingly adjustable from the third position to the fourth position for at least one of said second means to be connected to at least one of the first upstanding support and the second upstanding support.

16. An enclosure according to claim 15, wherein the first means is a length-adjustable laterally extending support, the second means is a plurality of collars, and the third means is a panel, and the fourth means is at least one of an adjustable portion of the panel and an adjustable portion of at least one of the plurality of collars.

17. A method for enclosing an area comprising:

positioning an enclosure about an area, the enclosure including an adjustable frame comprising an upper laterally extending support, a first upstanding support coupled to a first end of the upper laterally extending support, and a second upstanding support coupled to a second end of the upper laterally extending support, wherein the upper laterally extending support is adjustable in a length direction of the support between at least a first position and a second position; and an adjustable canopy configured to removably attach to the adjustable frame, the adjustable canopy comprising a plurality of collars configured to removably connect the canopy to the upper laterally extending support, the first upstanding support, and the second upstanding support, and at least one panel coupled to the plurality of collars such that the panel is held in a plane defined by the upper laterally extending support, the first upstanding support, and the second upstanding support;

wherein one or more of (i) the at least one panel or (ii) at least one of the plurality of collars is adjustable between a third position and a fourth position;

wherein one or more of (i) the at least one adjustable panel comprises at least one fastener comprising a first connector and a second connector, and a panel extension part attached to, disposed between, and extending in substantially the same direction as the first connector and the second connector, or (ii) the at least one adjustable collar comprises a first connector and a second connector, and a collar extension part attached to, disposed between, and extending parallel to the first connector and the second connector;

wherein, when the upper laterally extending support is adjusted from the first position to the second position, said at least one of said adjustable panel or said at least one adjustable collar is correspondingly adjustable from the third position to the fourth position for the canopy to be connected to at least one of the first upstanding support and the second upstanding support; and adjusting at least one of the adjustable frame and the adjustable canopy to change an area enclosed by the enclosure.

18. A method according to claim 17, wherein adjusting at least one of the adjustable frame and the adjustable canopy comprises:

adjusting the length of the upper laterally extending support in the length direction between the first position and the second position; and/or adjusting one or more of the adjustable panel or said at least one adjustable collar between the third position and the fourth position.

* * * * *